US005572817A

United States Patent [19]

Chien

[11] Patent Number: 5,572,817

[45] Date of Patent: Nov. 12, 1996

[54] MULTI-COLOR ELECTRO-LUMINESCENT LIGHT STRIP AND METHOD OF MAKING SAME

[76] Inventor: Tseng L. Chien, 8F, No. 29, Alley 73, Lin-Shen Street, Shi-Chi Town, Taipei, Hseng, Taiwan

[21] Appl. No.: 305,294

[22] Filed: Sep. 15, 1994

[51] Int. Cl.[6] ..... G09F 13/22

[52] U.S. Cl. ..... 40/544; 40/581; 40/580

[58] Field of Search ..... 40/544, 579, 580, 40/581; 362/84, 802

[56] References Cited

U.S. PATENT DOCUMENTS

| | | | |
|---|---|---|---|
| 3,284,941 | 11/1966 | Kaup | 40/544 |
| 3,780,430 | 12/1973 | Feeney | 29/626 |
| 4,587,753 | 5/1986 | Harper | 40/579 X |
| 4,645,970 | 2/1987 | Murphy | 40/544 X |

OTHER PUBLICATIONS

Klick et al., "Electroluminescence," *McGraw–Hill Encyclopedia of Science and Technology,* vol. 6, p. 139.

*Primary Examiner*—Kenneth J. Dorner
*Assistant Examiner*—Cassandra Davis
*Attorney, Agent, or Firm*—Bacon & Thomas

[57] ABSTRACT

A multi-color illuminated panel is made up of a decorative frontsheet having windows cut therein and which may include decorative patterns printed thereon, a transparent supporting sheet, which may also have decorative printing thereon, and a pre-wired backsheet in the form of a printed circuit board having multiple individual electro-luminescent light panel segments of different colors affixed thereto and electrically connected to traces on the circuit board, the electro-luminescent light segments of different colors emitting light which shines through corresponding windows and thereby provides a spectacular multi-color lighting effect.

11 Claims, 3 Drawing Sheets

MULTI-COLOR ELECTRO-LUMINESCENT LIGHT STRIP AND METHOD OF MAKING SAME

BACKGROUND OF THE INVENTION

1. Field of the Invention

This invention relates to the field of decorative lighting, and more particularly to an electro-luminescent (EL) light panel or strip having different colors and patterns, and to a method of making an electro-luminescent light strip or panel having different colors and patterns.

2. Discussion of Related Art

An electro-luminescent light panel or strip is a flexible enclosure which contains an electro-luminescent material, phosphor being a typical material, capable of emitting light when an electric current is discharged into or applied to the material.

An example of a conventional electro-luminescent light panel is shown in FIG. 1. The panel shown in FIG. 1 includes at least two protective layers and/or coatings 1,2, 10,11 on each exterior side of the structure 1,2,10,11, electrode 3 and 8, leads 4 and 10 connected to the electrode layers by a bus bar 6, and a phosphor layer sandwiched between the protective outer layers and in contact with the electrodes.

Such light panels have conventionally been limited, for reasons of cost and manufacturability, to a single color per panel or strip. While multiple colors are possible in such a panel, the multi-color effect can only be obtained by adding additional coatings or layers to the outside of the panels, which greatly increases the complexity of the manufacturing process, and prevents the light panels, despite their inherent attractiveness, from becoming competitive with alternative decorative lighting arrangements, including incandescent lighting, light emitting diode arrangements, and neon or fluorescent lighting for most applications.

The problem of cost involves not only the cost of manufacture, but also the materials costs of the light panel itself and of the multiple coatings conventionally necessary to obtain a multi-color effect. In the majority of applications, it is not necessary to light the entire panel or strip in order to provide the desired effect, but manufacturing considerations often dictate the entire panel be uniformly lit, resulting in higher material costs.

In addition to the above considerations, the use of bulk wiring in conventional electro-luminescent panel interconnections further increases their cost, and limits the range of potential applications. It is, for example, difficult to provide special effects such as motion or animation involving sequential turn on/off, chasing, or random fade-in/fade-out effects using conventional electro-luminescent panel arrangements, and thus LED panels are conventionally used for such purposes.

Finally, electro-luminescent panels have traditionally been limited to applications which make use of their attractiveness in the dark, the panels themselves being relatively plain and not particularly attractive unless lit. To-date, therefore, electro-luminescent panels have simply not been competitive with other lighting and decorative systems in all but a few narrow single-color applications.

SUMMARY OF THE INVENTION

It is accordingly a first objective of the invention to provide a method of making an electro-luminescent light strip or panel which overcomes the limitations of the prior art by reducing the amount of costly coatings and electro-luminescent materials required to obtain a desired lighting effect, by reducing the complexity of the process required to manufacture such a panel, and by increasing the flexibility of colorings, patterns, and special effects obtainable in the panel for an interesting and attractive appearance both in darkness and daylight.

It is also an objective of the invention to provide a simplified method of constructing an electro-luminescent light panel having the above-cited advantages over conventional electro-luminescent panels, including the capability of exhibiting a multiple colors, patterns, and special effects, for an interesting and attractive appearance both in darkness and daylight.

It is a further objective of the invention to provide a multi-color electro-luminescent light panel in which the multiple colors are provided without the need for multiple coating arrangements, and yet which is in the form of a single discrete panel formed by a single exterior frontsheet and a single exterior backsheet.

These objectives are accomplished, in a preferred embodiment of the invention, by providing a multi-color illuminated panel made up of a decorative frontsheet having windows cut therein, a transparent supporting sheet, which may also have decorative printing thereon, and a pre-wired backsheet on which are affixed discrete individual single-color electro-luminescent light panel segments, the electro-luminescent light segments being capable of having different colors and arranged to shine through the windows and provide a spectacular multi-color lighting effect. By using small localized electroluminescent panel segments, the materials costs for the electro-luminescent light panel is decreased while at the same time the design flexibility, and particularly the flexibility to choose different color patterns is significantly increased without a corresponding increase in manufacturing complexity.

In a particularly preferred embodiment of the invention, the small single color segments are arranged at predetermined locations on a single pre-wired backsheet and affixed by a non-mechanical means such as double-sided adhesive tape or glue for ease of assembly and decreased cost. The segments are then secured between the backsheet and a protective frontsheet layer by applying a pressure roller and/or heat to join the back and frontsheets according to known and relatively inexpensive methods of joining together two layers of material.

The protective frontsheet layer is preferably transparent and has affixed thereto a decorative frontsheet layer made of an attractive material such as leather or a high quality plastic such as polyvinylethylene (PVE) through which are cut or stamped openings at the locations of the small individual electro-luminescent light segments to permit the light from the segments to be visible from the front of the panel, and on which lettering or decorative patterns may be printed, painted, or silk-screened to form an arrangement which is attractive not only in the dark but also in daylight, which uses just enough of the electro-luminescent materials to obtain a desired effect, and which is simple to construct.

Those skilled in the art will appreciate that, because of its flexibility and low cost, the multi-color light panel of the preferred embodiment will be useable in a wide variety of purposes for which conventional electro-luminescent light panels have previously been considered to be unsuitable, including advertising displays, signs, posters, greeting cards, and even fine artwork, and thus the electro-luminescent light panel described and claimed herein represents a significant and unexpected improvement over conventional electro-luminescent light panel arrangements.

DETAILED DESCRIPTION OF THE PREFERRED EMBODIMENTS

Figure 2:
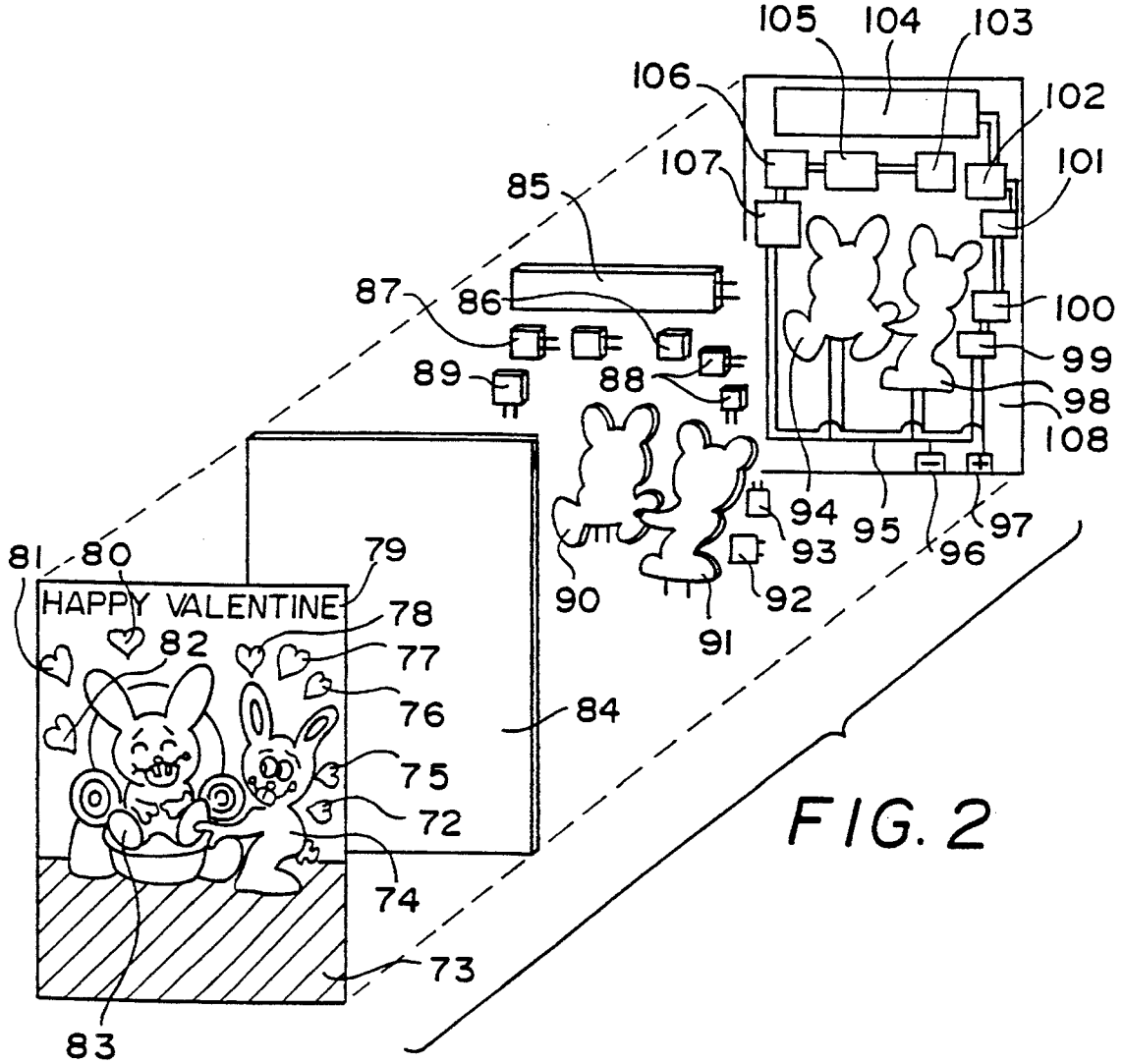
FIG. 2 and 2A are exploded perspective views of electro-luminescent light panels constructed in accordance with the principles of preferred embodiments of the invention.

FIG. 2 is a detailed perspective view of a particular electro-luminescent light panel which is intended to illustrate the principles of a preferred embodiment of the invention. Those skilled in the art will appreciate, however, that the specific patterns and structures shown in the drawings are intended to be exemplary only, and that numerous variations and modifications of the illustrated embodiment are possible, including but not limited to the variation shown in FIGS. 3 and 4. In fact, in a sense, it is the unique construction of the invention that makes possible the large number of possible variations and modifications.

The principal components of the multi-color illuminated panel of this embodiment are a decorative front layer 73 having windows 72–83 cut or stamped therein, a transparent supporting front layer 84 which together with layer 73 forms a frontsheet for the panel, and which may also have decorative printing thereon, and a pre-wired backsheet 108 on which are affixed discrete individual single-color electro-luminescent light panel segments 85–93, the electro-luminescent light segments 85–93 being arranged to shine through the windows and provide a spectacular multi-color lighting effect.

Figure 1:
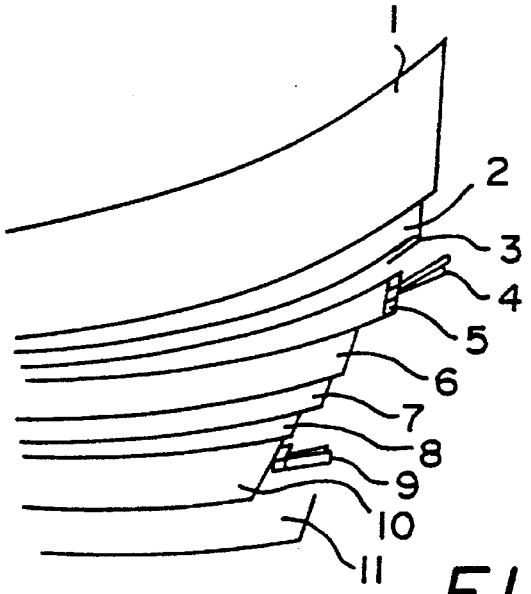
FIG. 1 (PRIOR ART)
FIG. 1 is a perspective view of a conventional electro-luminescent light panel.
Figure 5:
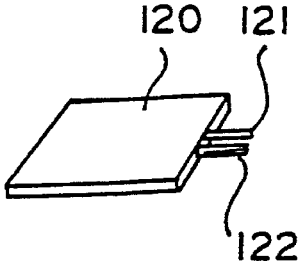
FIG. 5 is a perspective view showing one of the small electro-luminescent light segments used in the embodiments of FIGS. 2–5.

A typical individual light segment is illustrated in more detail in FIG. 5. The construction of the individual light segment shown in FIG. 5 and used in the preferred embodiment may be identical to the conventional light panel shown in FIG. 1, although those skilled in the art will appreciate that the construction and type of electro-luminescent light panel used may be modified without departing from the spirit of the invention. As illustrated, the light segment includes an outer covering 120 which encloses a pair of electrodes, a phosphor or similar electro-luminescent material, and a bus bar (not shown in this Figure). Extending from covering 120 are a pair of leads 121 and 122 which are to be connected to prearranged wiring on the backsheet 84 at locations 94 and 98–107 illustrated in FIG. 2.

In the preferred embodiment, as explained below, three different colors of electro-luminescence are employed, although those skilled in the art will appreciate that the a wide variety of differently colored electro-luminescent light segments are available and could be used in the preferred embodiment. In addition, it will be noted by those skilled in the art that, while most of the illustrated segments have a square or rectangular shape, segments 90 and 91 are in the shape of rabbits, and that the segments could easily be made in any desired shape, although the use of regular shaped segments is most economical.

In a particularly preferred embodiment of the invention, the small single color segments 85–93 are affixed to the pre-wired backsheet 108 at locations 94 and 98–107 and affixed by a non-mechanical means such as double-sided adhesive tape or glue for ease of assembly and decreased cost. The segments are then secured between the backsheet and the protective frontsheet layer 84 by applying a pressure roller and/or heat to join the back and frontsheets according to known and relatively inexpensive methods of joining together two layers of material. The joining of the materials may also be facilitated by the use of adhesives, and/or by the use of the same material, which should be strong enough to provide support and protection for the light segments, but which may also be flexible if desired. An example of a suitable material is PVE.

The protective frontsheet layer 84 preferably transparent and has affixed thereto a decorative frontsheet layer 73 made of an attractive material such as leather, foil, paper, or a high quality plastic such as PVE through which are cut or stamped openings at locations 74–83 corresponding to the locations 94 and 98–107 of the small individual electro-luminescent light segments to permit light, upon illumination of the segments, to be visible from the front of the panel, and on which lettering or decorative patterns may be printed, painted, or silk-screened to form an arrangement which is attractive not only in the dark but also in daylight, which uses just enough of the electro-luminescent materials to obtain a desired effect, and which is simple to construct.

As illustrated, decorative frontsheet layer 73 includes the following cutouts, which may be augmented or enhanced by designs printed, painted, drawn, silk-screened or otherwise imprinted in the non-cutout areas of the sheet:

(1) a message 79, which says "HAPPY VALENTINE";

(2) various hearts 75–83; and (3) cartoon rabbits 74 and 83.

As noted above, the light segments corresponding to the cutouts are regular in shape, with the light segment 85 corresponding to the valentine's greeting having an extended rectangular shape.

Figure 4:
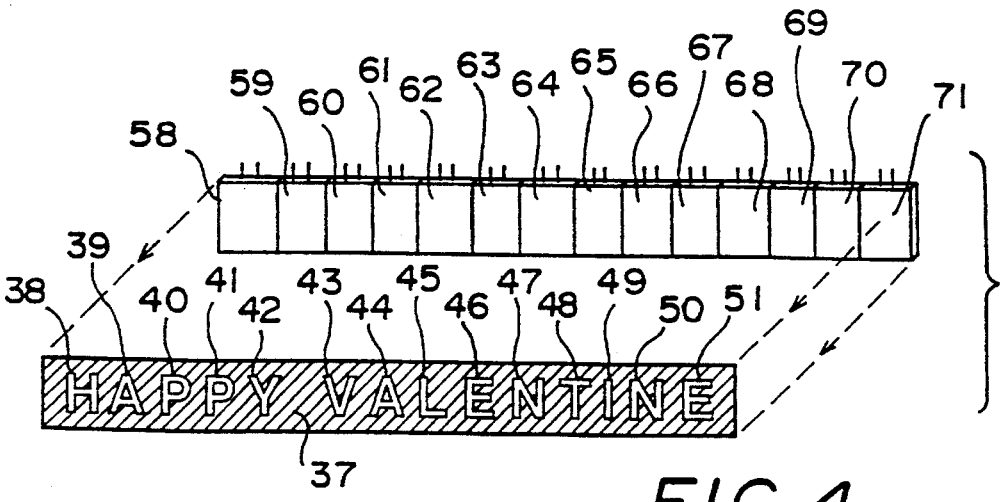
FIG. 4 is an exploded perspective view showing another variation of the electro-luminescent light panel of FIG. 2.

An alternative arrangement for the "HAPPY VALENTINE" message is shown in FIG. 4. As in the preferred embodiment of FIG. 2, the portion of the decorative frontsheet 73 through which the light from the electro-luminescent segment is to appear is cut or stamped to form letters 38–51, collectively designated by reference numeral 37. However, in this embodiment, instead of a single electro-luminescent panel 85, a plurality of electro-luminescent panels 59–71 are included, each of which may be a different color if desired.

Figure 2A:
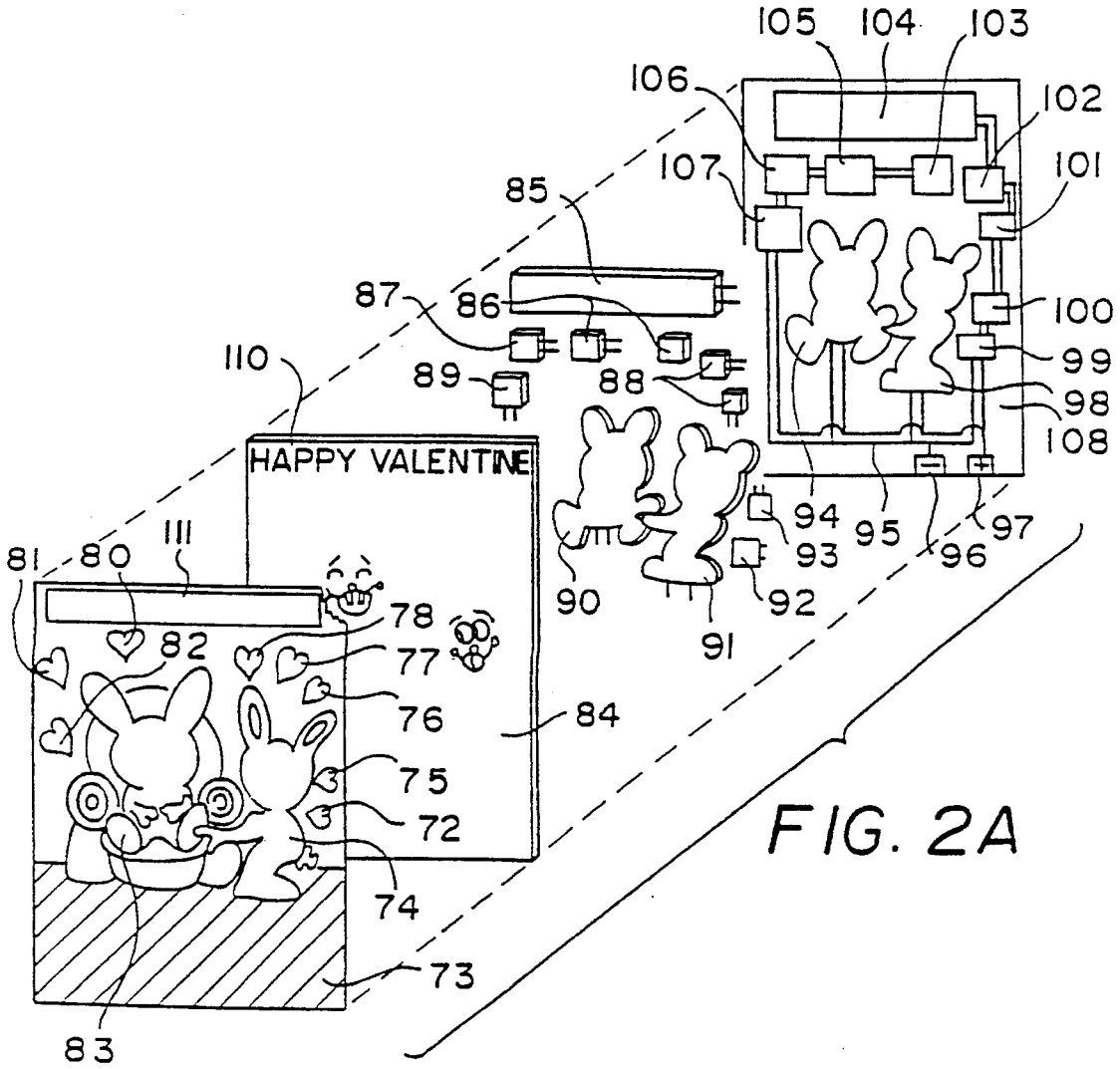

Alternatively, those skilled in the art will appreciate that the lettering for the message may also be obtained, as shown in FIG. 2A, by including a single extended rectangular cutout (111) in decorative front panel 73 and forming the letters by applying an opaque pattern (110) to layer 84, silk-screening, painting, block printing, or the like. Similar variations can also be made to other parts of the frontsheet, particularly if the cost of the material of the decorative front layer is high, i.e., while the supporting front layer 84 is preferably made of a fully transparent material, and is performs the structural role of holding the individual small electro-luminescent segments in position against backsheet 108, layer 84 could also be printed with a design such as a cartoon or message on the outside surface to reduce the material cost of the decorative frontsheet layer 73 by cutting away the decorative layer to reveal patterns on the supporting layer 84.

Examples of the manner in which the small single color segments 85–93 are used to provide a multi-color effect are as follows, although those skilled in the art will appreciate that the selection of colors depends solely on the aesthetic taste of the designer and not on any functional considerations:

(1) the letters "HAPPY VALENTINE" are illuminated by purple colored segments at location 104 (or by multiple single color segments as illustrated in FIG. 4;

(2) the two rabbits 74 and 83 are backed by pink a segment for rabbit 90 and a white segment for rabbit 91 at locations 94 and 98; and (3) hearts 72–82 are lit by red segments 89–93 at respective locations 99–107.

In order to further simplify assembly and reduce costs, as well as providing for special effects, the backsheet 108 may be in the form of a printed circuit board for the electro-luminescent light segments which includes printed traces 95 made by well-known foil stamping or similar techniques, and may include appropriate switches to turn the segments on and off as well as connection terminals 96 and 97 for connecting the segments which may either be series or parallel connected, to a power supply (not shown). The use of a printed circuit board as the backsheet also makes it especially convenient to include circuitry for providing special effects such as sequential, rhythmic, or random on and off switching for the individual electro-luminescent light segments, in order to provide illusions of motion or otherwise further draw the attention of the viewer to the display.

Figure 3:
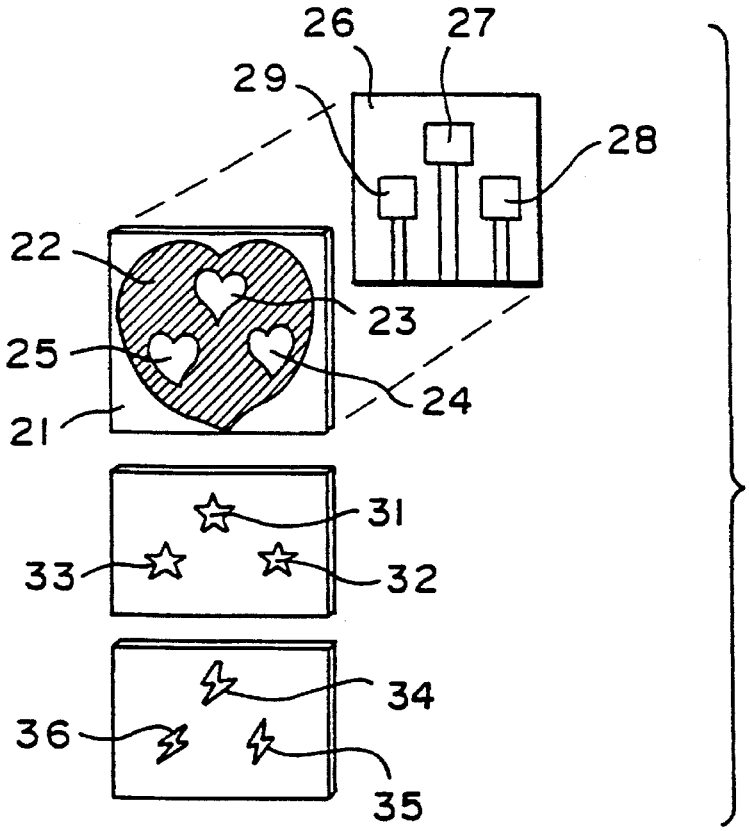
FIG. 3 is an exploded perspective view showing a variation of the electro-luminescent light panel of FIG. 2.

A particularly advantage feature of this arrangement, illustrated in FIG. 3, is that the same backsheet can be used with a variety of different frontsheets, thereby further saving production costs. In the example shown, a single backsheet 26 including individual electro-luminescent light segments 27–29 is arranged to be used with at least different designs for a frontsheet 21, including one having a large printed heart and heart-shaped cutouts 23–25 corresponding to the locations of light segments 27–29, a second design made up of three star-shaped cutouts 31–33 also corresponding in location to the location of light segments 27–29, and finally a third more abstract design also involving cutouts located to allow light from the individual light segments to shine through the frontsheet.

As implied by the above description, the preferred method of making the above-described light panel involves the following steps, not necessarily in the order in which they would be performed:

(1) cutting windows into the decorative front layer 73 and printing decorative designs thereon;

(2) pre-wiring a circuit on backsheet 108 and marking locations for placement of the electro-luminescent light segments 85–93 corresponding to the locations of the windows;

(3) affixing electro-luminescent light segments to the backsheet, using glue or double-sided adhesive tape, at locations which permit light from the light segments to show through the frontsheet and electrically connecting the segments to the pre-wired portions of the backsheet, for example by soldering; and (4) affixing the front layer 84 to the backsheet 108 using an adhesive, a pressure roller possibly in combination with the application of heat, or other known methods of joining two layers or sheets of material together, and affixing the decorative frontsheet layer 73 to the supporting frontsheet layer 84 using known methods depending on the materials of the respective layers.

Having thus described a specific preferred embodiments of the invention in terms which will enable those skilled in the art to make and use the invention, it will nevertheless be appreciated that numerous variations and modifications are possible within the scope of the invention. Consequently it is intended that the invention not be limited by the above description or drawings, but rather that it be limited solely by the appended claims.

We claim:

1. A multi-colored illuminated panel arrangement, comprising:

a first frontsheet layer having a plurality of windows;

a transparent second frontsheet layer;

a backsheet layer having affixed thereto a plurality of discrete electro-luminescent light segments; and electrical circuit means on the backsheet layer for electrically connecting the light segments respectively to a power supply, wherein said backsheet layer and said second frontsheet layer are sealed together with the light segments positioned therebetween, and the first frontsheet layer is affixed to and supported by the second frontsheet layer such that the light segments emit light through said transparent second frontsheet layer and through said windows in the first frontsheet layer.

2. An arrangement as claimed in claim 1, wherein said first frontsheet layer is made up of a sheet having decorative printing thereon and cut-outs which form said windows.

3. An arrangement as claimed in claim 2, wherein the first frontsheet layer is further cut away to reveal printing on the second frontsheet layer.

4. An arrangement as claimed in claim 1, wherein said backsheet is a printed circuit board.

5. An arrangement as claimed in claim 1, wherein the light segments are affixed to the backsheet layer by double-sided tape.

6. An arrangement as claimed in claim 1, wherein the light segments are affixed to the backsheet layer by glue.

7. An arrangement as claimed in claim 1, wherein said first frontsheet layer is made from a material selected from the group consisting of paper, leather, foil, and plastic, and said second frontsheet layer is a transparent layer made of plastic.

8. A multi-colored illuminated panel arrangement, comprising:

a first frontsheet having a plurality of windows;

a backsheet having affixed thereto a plurality of discrete electro-luminescent light segments; and electrical circuit means including a plurality of conductive terminals on the backsheet for electrically connecting the light segments respectively to a power supply, wherein said backsheet and said frontsheet are sealed together with the light segments positioned therebetween such that the light segments emit light through said windows in the frontsheet layer.

9. An arrangement as claimed in claim 8, wherein said backsheet is a printed circuit board.

10. An arrangement as claimed in claim 8, wherein the light segments are affixed to the backsheet by double-sided tape.

11. An arrangement as claimed in claim 8, wherein the light segments are affixed to the backsheet by glue.

* * * * *